United States Patent [19]

Gray

[11] Patent Number: 4,585,362

[45] Date of Patent: Apr. 29, 1986

[54] ONE-TOUCH CHARACTER CORRECTION AND REPLACEMENT SYSTEM

[75] Inventor: R. William Gray, Ithaca, N.Y.

[73] Assignee: SCM Corporation, New York, N.Y.

[21] Appl. No.: 679,342

[22] Filed: Dec. 7, 1984

[51] Int. Cl.[4] ..... B41J 29/367

[52] U.S. Cl. ..... 400/697.1; 400/212; 400/214; 400/320

[58] Field of Search ..... 400/17, 208, 695, 696, 400/697, 697.1, 212, 214, 320

[56] References Cited

U.S. PATENT DOCUMENTS

| | | | |
|---|---|---|---|
| 3,045,218 | 7/1962 | Brand | 400/697 X |
| 3,780,846 | 12/1973 | Kolpek et al. | 400/17 X |
| 4,270,865 | 6/1981 | Konishi | 400/697 X |
| 4,286,889 | 9/1981 | Ebert et al. | 400/697.1 |
| 4,364,679 | 12/1982 | Longrod et al. | 400/212 |
| 4,374,626 | 2/1983 | Hooker | 400/697.1 |
| 4,381,553 | 4/1983 | Ferguson | 400/17 X |
| 4,395,149 | 7/1983 | Longrod | 400/215 |
| 4,396,305 | 8/1983 | Shattuck et al. | 400/208 |
| 4,408,915 | 10/1983 | Smith | 400/290 |
| 4,408,918 | 10/1983 | Smith | 400/697.1 |
| 4,436,192 | 3/1984 | Longrod | 192/43.1 |
| 4,480,931 | 11/1984 | Kamikura et al. | 400/697 X |

FOREIGN PATENT DOCUMENTS

| | | | |
|---|---|---|---|
| 0207084 | 12/1982 | Japan | 400/208 |

*Primary Examiner*—Ernest T. Wright, Jr.

*Attorney, Agent, or Firm*—William E. Mear, III; Ernest F. Weinberger

[57] ABSTRACT

In an electronic correcting typewriter, a character correction and replacement system is disclosed for facilitating the task of correcting typed character errors. The typewriter includes a printing and a correcting mechanism operated under electronic control and a correction buffer is associated with the electronic control for storing the last plurality of printed characters. To automatically erase any previously printed character which character has its code stored in the correction buffer and print a new replacement character, the typist locates the carrier opposite the unwanted character and actuates the character key of the desired replacement character. Under control of the electronics, the unwanted character code is recalled from the correction buffer, the correcting mechanism is operated to erase that character and the printing mechanism is operated to print the new character. Operator setting of an overstrike flag provides character overprint capability.

6 Claims, 4 Drawing Figures

ONE-TOUCH CHARACTER CORRECTION AND REPLACEMENT SYSTEM

BACKGROUND

1. Field of the Invention

This invention relates to error correcting systems for electronic correcting typewriters. More particularly, it relates to a one-touch correction system providing character correction and replacement through selection of only the replacement character key.

2. Prior Art

Typewriter manufacturers are continually seeking to develop error correcting systems that facilitate the task of correcting errors. Electronics in typewriters have promoted error correction in that the typewriter is afforded the ability to "remember" the last plurality of typed characters which characters can be automatically recalled from memory for correction purposes. Such so called "self" correcting systems have made the task of erasing characters simpler by providing a correction key that eliminates the burden of actuating the character key of the unwanted character. After the unwanted character is erased, the operator prints the desired character selecting the replacement character key. Thus, the time taken to make a correction and the probability of making a correcting mistake are reduced.

Efficient as these prior electronic correcting systems operate, there remains a need for improvement in terms of minimizing key strokes so as to further lessen the burden and time taken by the operator in making character corrections and replacements.

SUMMARY OF THE INVENTION

Applicant discloses a new one-touch character correction system wherein character correction and replacement is made dependent upon the printing unit being stationed at a previously printed character and is operated by actuation of only one key, namely the key of the replacement character. In response to actuation of the replacement character key, the previously printed character at the current carrier print point is recalled from memory for actuation over the correction ribbon to erase that character. The selected replacement character is then processed to print in the just erased position. Accordingly, only one key stroke operation is needed to erase an erroneously printed character and to print the new replacement character. In this fashion, the present system offers a very efficient one-touch correction and replacement feature.

OBJECTS OF THE INVENTION

Accordingly several objects of the present invention are to provide an electronic correcting typewriter with a character correction and replacement system, to provide a character correcting system that erases a previously printed character and prints a replacement character by a single key stroke operation, to provide a character correcting system having character correction made operatively dependent upon the printing unit being opposite a previously printed character and to provide a truly one-touch correction and replacement system facilitating the task of making corrections. Further objects and advantages will become apparent from a consideration of the ensuing description and the accompanying drawing.

CROSS REFERENCE TO RELATED APPLICATIONS

The following patent cases described various other inventions which can be used concurrently with the present invention; these applications disclose various details and other aspects relating to the operation and construction of the typewriter discussed herein:

I. U.S. Pat. No. 4,408,915, issued on Oct. 11, 1983, entitled Reverse Tab Control for Typewriters, of Michael H. Smith, II. U.S. Pat. No. 4,364,679, issued on Dec. 21, 1982, entitled Cartridge Ribbon Lift Apparatus, of Scott J. Longrod and Francis R. Oakley;

III. U.S. Pat. No. 4,396,305, issued on Aug. 2, 1983, entitled Ribbon Cartridge Handling Apparatus, of Richard E. Shattuck and Francis R. Oakley;

IV. U.S. Pat. No. 4,395,149, issued on July 26, 1983, entitled Ribbon Drive Mechanism, of Scott J. Longrod; and V. U.S. Pat. No. 4,436,192, issued on Mar. 13, 1984, entitled Ribbon Drive Clutch, of Scott J. Longrod; and all of the above-mentioned cases have the same assignee as the present invention.

DETAILED DESCRIPTION OF THE INVENTION

Figure 1:
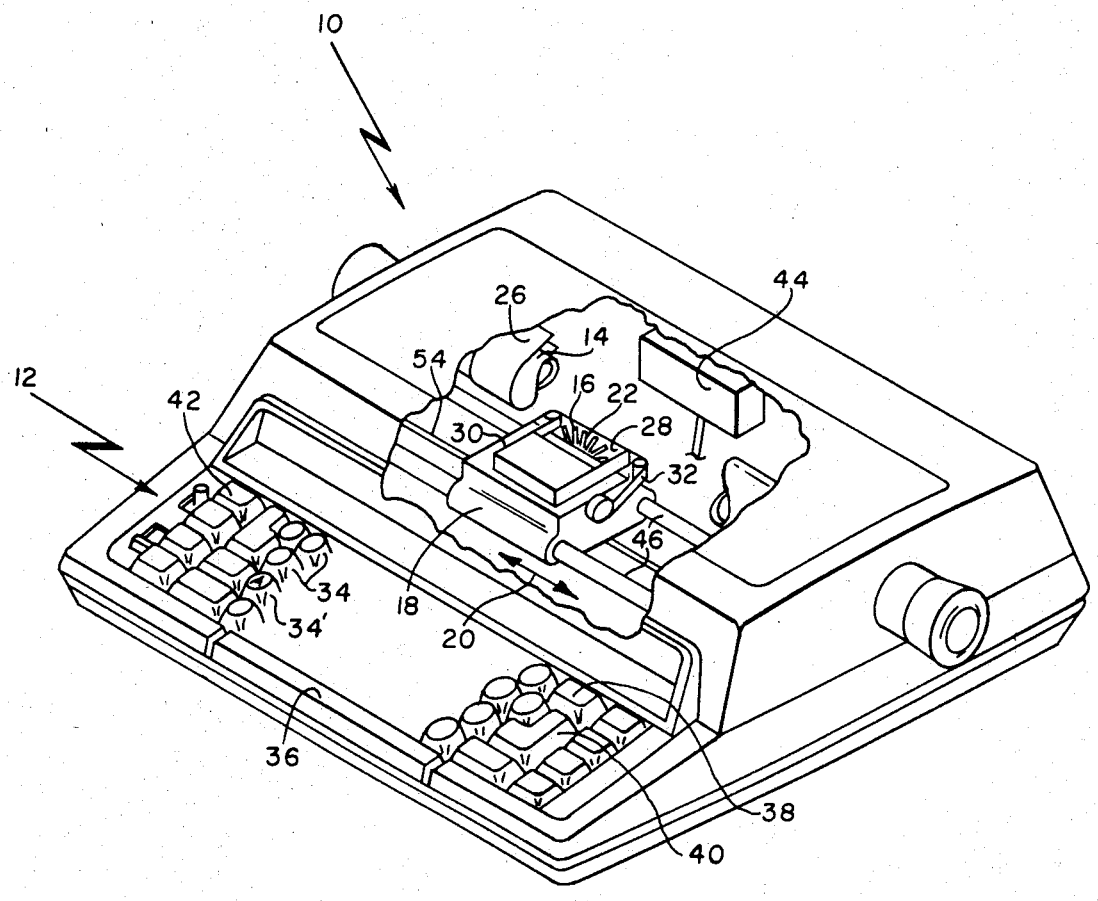
FIG. 1 is an isometric frontal view of an electronic correcting typewriter partially sectioned to show components operated according to the teachings of the present invention.

An electronic correcting typewriter 10 according to the invention is shown in FIG. 1. Generally, typewriter 10 comprises a keyboard 12, a platen 14, a print wheel 16 and a carrier 18 which supports the print wheel 16. The carrier 18 is mounted in the typewriter 10 for left and right horizontal movement along platen 14 as is indicated by arrows 20.

Print wheel 16, also known as a "daisy" wheel, has a plurality of radial petals or spokes 22, each supporting a respective character of the keyboard 12. A print hammer 24 (FIG. 2) is positioned adjacent print wheel 16 for striking an aligned petal 22 against a sheet of paper 26 or other recording medium supported on platen 14.

A print ribbon mechanism includes an exposed portion of inked ribbon 28 extending from a cartridge 30 which is mounted on the carrier 18. Carrier 18 also supports a correction mechanism including a correction ribbon 32. Inked ribbon 28 may be an inked fabric or carbon kind of ribbon and correction ribbon 32 may be of a kind having a coating of adhesive or white overlay material for making lift-off or cover-up corrections.

Keyboard 12 contains the usual plurality of character keys 34 and carrier control function keys including a spacebar 36, a back space key 38, a carrier return key 40 and a code key 42. Upon actuation of any key on keyboard 12, a respective keyboard output signal is communicated to an electronic control circuit 44 which has various outputs controlling functions and operations of typewriter 10, principally, operation of the print wheel 16 and other components assembled on carrier 18.

More specifically, when a character key 34 is depressed to print, e.g., key 34' representing the letter "a", a unique signal representative of that character is communicated to control circuit 44 which in turn generates appropriate commands for (1) rotating the print wheel 16 to bring the selected character petal 22 upright, (2), lifting the print ribbon 28 beteen the petal 22 and the sheet of paper 26, and (3) actuating the print hammer 24. The letter "a" will thus be imprinted over print ribbon 28 onto paper 26.

Further, when the spacebar 36 is depressed, a unique signal representing a forward "space" move to the right is communicated to control circuit 44 which in turn controls the carrier 18 to move forard one character position without printing. In a similar manner, carrier 18 is controlled to move backwards one character position in response to actuation of the back space key 38. When the carrier return key 40 is actuated, the carrier 18 is caused to move leftwardly to the position of the left margin or stop setting and the paper 26 is indexed or fed upwardly for exposing a fresh print line.

Figure 2:
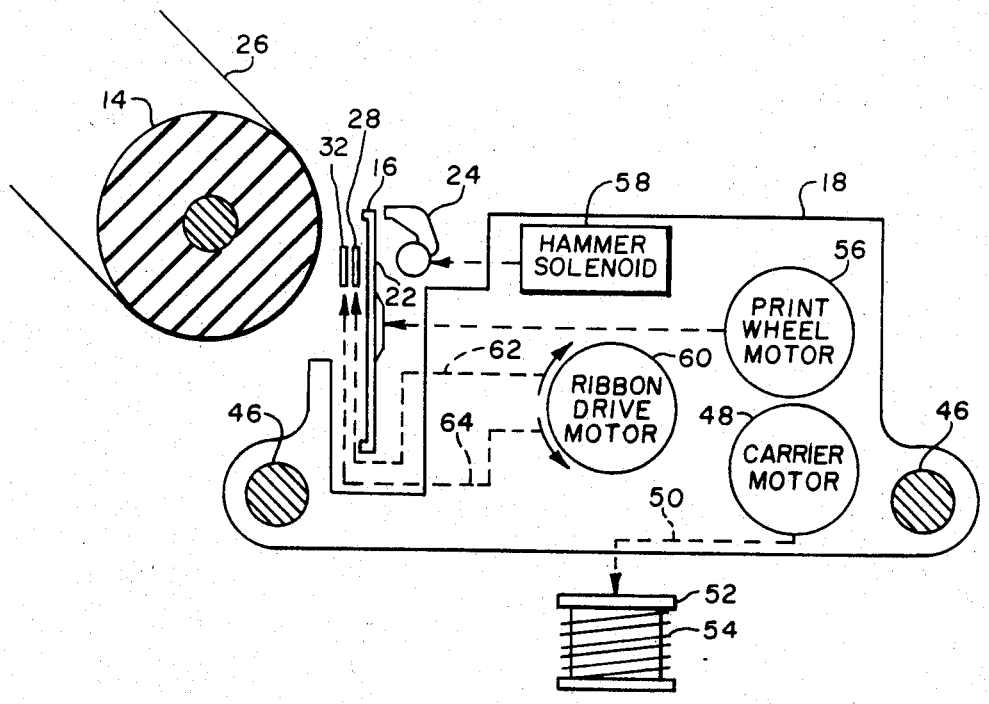
FIG. 2 is a schematic side view of the print carrier and the platen of the electronic correcting typewriter of FIG. 1.

FIG. 2 shows a schematic diagram of the principal mechanisms assembled on carrier 18 and their relationship to platen 14. The showing of FIG. 2 is schematic only in order to facilitate an understanding. The actual components of the mechanisms are relatively known in the art and such details are not directly relevant to the present invention.

As previously mentioned, carrier 18 is able to move horizontally to the left and right as indicated by arrow 20 of FIG. 1. Carrier 18 is supported to slide on guide rails 46 fixedly mounted to extend parallel to platen 14. A Carrier Motor 48 is coupled by a mechanical linkage, schematically represented by a broken line 50, to rotatively drive a cable pulley 52. A cable 54 is wound about pulley 52 in a manner permitting simultaneous winding and unwinding. Carrier Motor 48 is operated under control of control circuit 44 for causing carrier 18 to move to the left or to the right along the platen 14.

Print wheel 16 is operated by a Print Wheel Motor 56 so that any radial petal 22 can be rotatively brought upright for printing. Print Wheel Motor 56 is also operated under control of control circuit 44. After the selected character petal 22 is located upright, hammer 24 is fired by a connected Hammer Solenoid 58 also under control of the control circuit 44. The upright petal 22 is deflected by the propelling hammer 24 to strike against the paper 26 on the platen 14 for either printing over print ribbon 28 or erasing over correction ribbon 32 when typewriter 10 is operated in correction mode.

The ribbons 28, 32 are operated by a ribbon drive motor 60 under control of the control circuit 44. A mechanical linkage, schematically represented by broken line 62, couples the ribbon drive motor 60 to operate print ribbon 28 and a mechanical linkage 64 is connected from motor 60 to enable operation of the correction ribbon 32. The Ribbon Drive Motor 60 operates one ribbon when driven in one direction and operates the other ribbon when driven in the other direction. For example, when the Ribbon Drive Motor 60 is powered clockwise, the print ribbon 28 is raised and, when the Ribbon Drive Motor 60 is operated in correction mode to rotate counterclockwise, the correction ribbon 32 is raised as is illustrated in FIG. 2.

Figure 3:
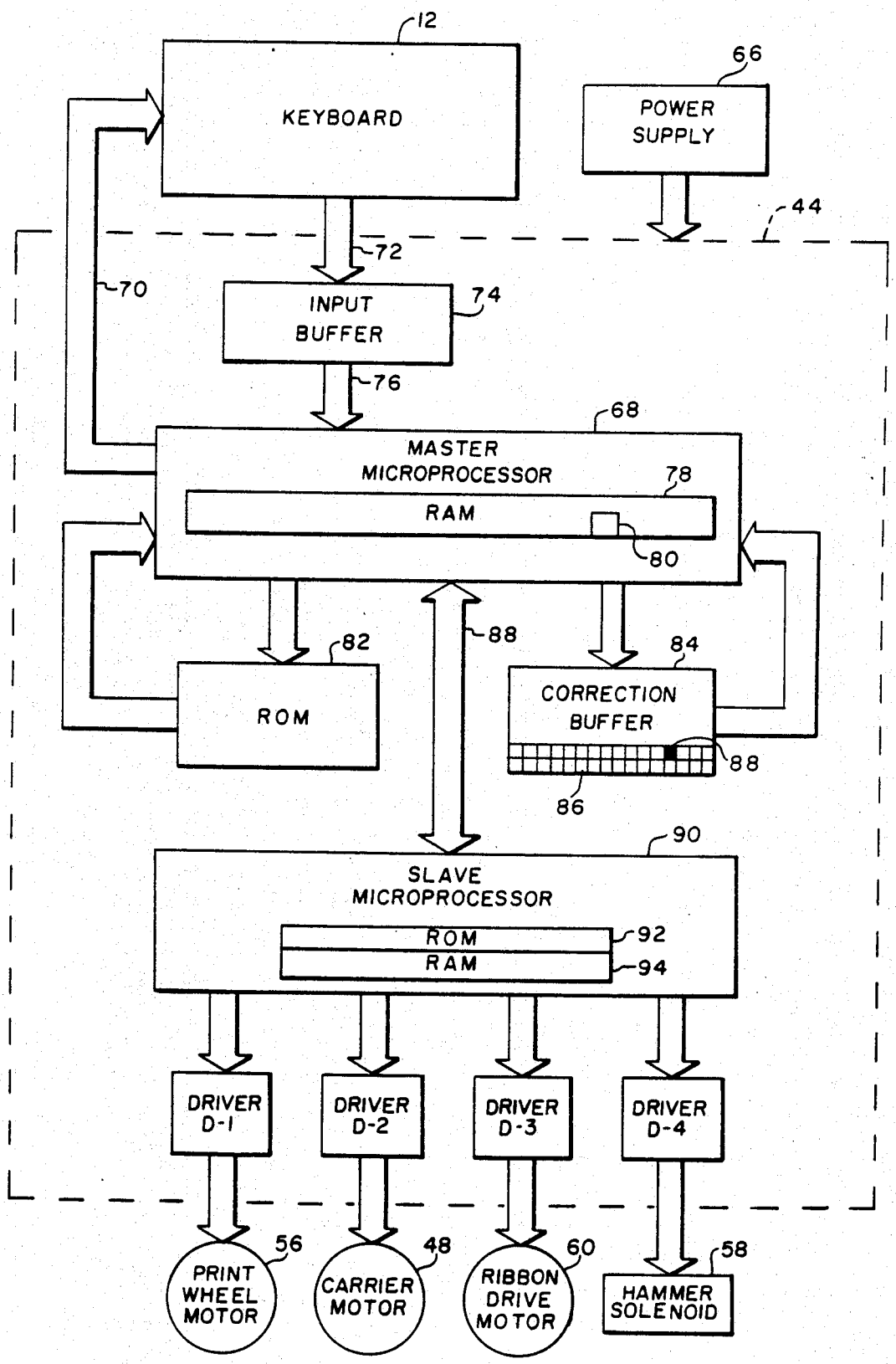
FIG. 3 is a block diagram of the electronics for controlling functional operations of the typewriter including one touch character correction and replacement.

The block diagram of FIG. 3 provides an overall view of the control circuitry 44 used for implementing the correction and replacement function of the present invention. A Power Supply 66 is connected to supply the electric power necessary to operate the various electronic components in control circuitry 44. As is shown in FIG. 3, keyboard 12 communicates with a known Master Microprocessor 68 as a result of an equally known interrupt technique issued periodically (e.g. every 7 milliseconds) on bus line 70. Master Microprocessor 68 is a known electronic component, such as, the 8031 made by Intel Corporation of Cupertino, Calif. As a result of the interrupt, the keyboard 12, and more particularly, the matrix arrangement of keys is scanned to detect any key actuations. A logic code signal representative of a key actuation appear on bus line 72 extending to an Input Buffer 74. Keyboard signals are temporarily stored by the Input Buffer 74 when a preceding signal is being processed by the typewriter 10. Keyboard signals are released from Input Buffer 74 in the order of keyboard input. Master Microprocessor 68 receives data from Input Buffer 74 via bus line 76. The Input Buffer 74 is a Hex Non-Inverting buffer, such as a CD 4503 manufactured by National Semiconductor of Santa Clara, Calif.

Master Microprocessor 68 includes an internal Random Access Memory or RAM 78 having at least one flag 80. The code information on bus 76 is utilized as a pointer to operate the flag 80 of RAM 78. According to an aspect of the invention, the flag 80 in RAM 78 relates to a character overstrike feature. The overstrike flag 80 is normally in a clear condition and is set in response to the operator depressing a designated keyboard key, i.e., code key 42 in keyboard 12 (FIG. 1). In the present typewriter 10, a print overstrike cannot normally occur. That is to say one character is not normally permitted to be printed in a position already occupied by a previously printed character. However, a print overstrike is allowed to occur when the overstrike flag 80 is set.

Master Microprocessor 68 is associated with external electronics including a ROM unit 82 for controlling operation of Master Microprocessor 68. A Correction Buffer 84 is operatively associated with Master Microprocessor 68 and includes a stack of registers or memory cells 86 for storing code information of selected characters processed by Master Microprocessor 68. The Correction Buffer 84 is addressable through a pointer or cursor 88 (shown solid), located at one register corresponding to the current location of carrier 18. In this regard the character of the current carrier 18 position can be recalled from Correction Buffer 84 for correction purposes. Cursor 88 progressively moves through the stack of registers 86 in conjunction to movement of carrier 18 so that one register has character information of a related one character position along platen 14. A 4096 bit (1024×4 bits) static RAM identified as 2114 preferably comprises Correction Buffer 84.

A character code signal ready for typewriter processing is sent along line 88 (output channels) from Master Microprocessor 68 to a further microprocessor 90 which is slaved with respect to microprocessor 68 as master. Slave Microprocessor 90 (e.g. the 8051 also made by Intel and identical to the 8031 except for program memory) has an internal program stored in a ROM (4 K×8 Read Only Memory) 92 and the code data being stored in a RAM (128×8) 94. Code data is read from RAM 94 as necessary for the program in ROM 92 to develop, in known fashion, the control and drive signals for operational control of the various elements of carrier 18, namely, Printwheel Motor 56, Carrier Motor 48, Ribbon Drive Motor 60 and Hammer Solenoid 58.

External Drivers D-1, D-2, D-3 and D-4 are connected to receive code data read from RAM 94 of Slave Microprocessor 90 for controlling operation of motors 56, 48, 60 and solenoid 58, respectively. Drivers D-1, D-2 and D-3 are conventional Quad Drivers (e.g. 2069) for decoding the data and for issuing appropriate control signals to connected motors 56, 48, and 60. The driver control signals regulate precise angular rotation and direction of motors 56, 48, and 60. Driver D-1 issues appropriate signals to Printwheel Motor 56 for rotatably positioning print wheel 16 according to the code generated by the one of the character keys 34. Driver D-2 develops the signals necessary for stepping Carrier Motor 48 to incrementally move carrier 18 through character positions along platen 14. Driver D-3 controls the Ribbon Drive Motor 60, such that, print ribbon 28 is operated (via linkage 62) for printing when motor 60 is energized to rotate in one direction (clockwise in FIG. 2) and correction ribbon 32 is enabled (via linkage 64) for erasing when motor 60 is energized to rotate in the opposite (counterclockwise) direction. Typewriter 10 is operating in correction mode when Ribbon Drive Motor 60 is controlled to rotate in the counterclockwise direction enabling ribbon 32. Driver D-4 is in the form of a known kind of electronic latch for controlling operation of Hammer Solenoid 58 and is timed with respect to the other drivers 1-3 such that hammer 24 is actuated after printwheel character selection is made and one of the ribbons 28, 32 is elevated.

Figure 4:
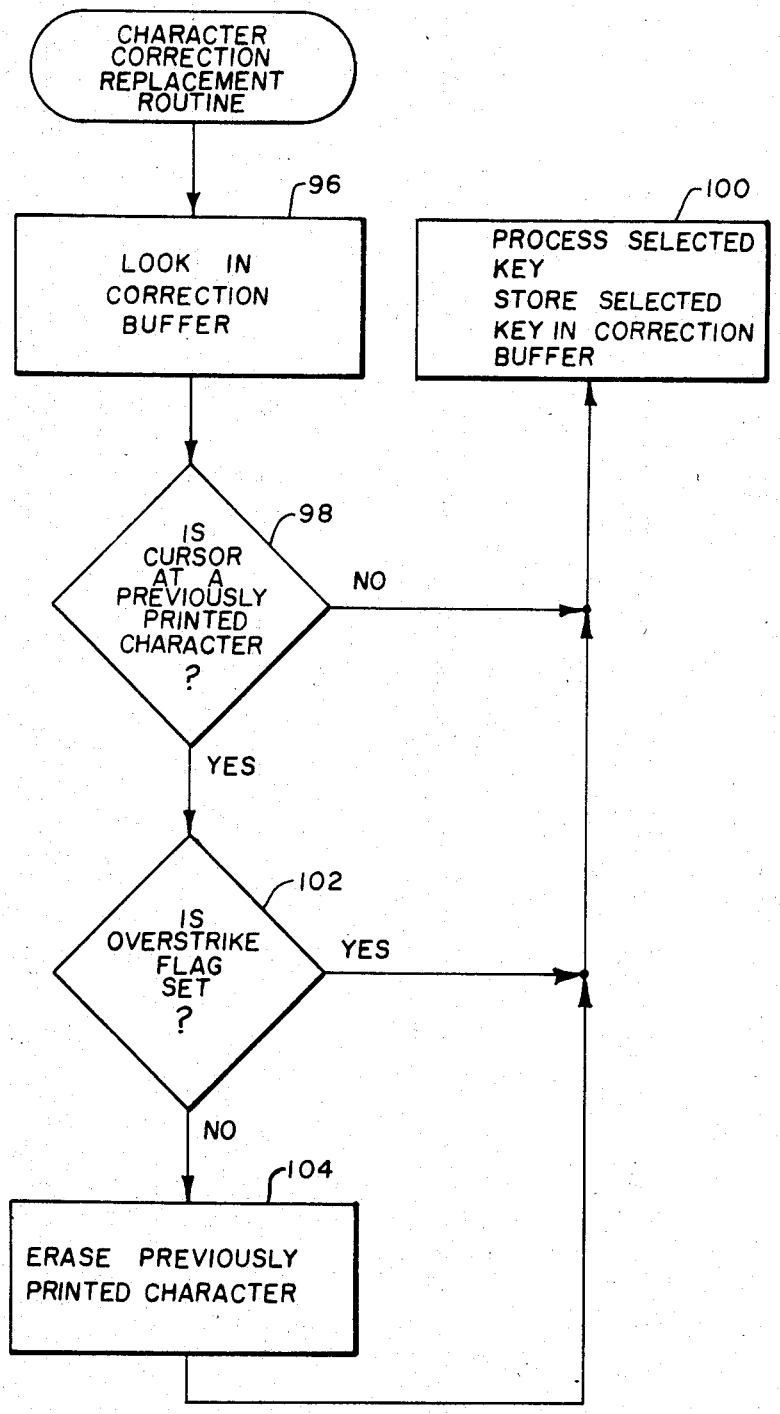
FIG. 4 is a flow chart of the character correction and replacement routine according to the present invention.

In the flow chart of FIG. 4, the following conventional box shapes are used: boxes with semi-circular ends represent the start of a subroutine, a rectangle represents a processing function or an operation, and a diamond represents a decision for selecting one of two alternative outputs. As with most microprocessors, the control circuit 44 of FIGS. 1 and 3 has a regular idling in which it makes rounds or sequential interrogations of the various registers and initiates certain routines or operations according to the status of these registers or flags. For clarity and ease of description, only the portions of routines relevant to the present character correction and replacement feature are depicted in the flow chart, other routines which can be taken by Master Microprocessor 68 during its ordinary operation not being detailed, though certain of these other routines are discussed in the copending applications listed originally.

In accordance with the invention, in FIG. 4 there is a subroutine entitled "Character Correction Replacement Routine". The first Box 96 in this routine relates to the first operation which includes electronically looking (address) at the character status of the cursor position 88 in Correction Buffer 84. According to Box 98, the first decision made is to determine whether the cursor 88 and, therefore the carrier 18, is currently stationed at a print line position occupied by a previously printed character. If not, the flow is the NO path to functional operation Box 100 wherein the selected key is processed normally by the typewriter 10 and the processed character data is stored in the register pointed to by cursor 88 in Correction Buffer 84. If it is determined in Box 98 that the current carrier position is occupied by a previously printed character than the YES path is taken to initiate the character correction portion of the present invention. In decision Box 102, the overstrike flag 80 in RAM 78 of Master Microprocessor 68 is checked to determine its current status with respect to being either in a "set" or "clear" state. If the overstrike flag 80 is "set", the selected key is processed normally to provide overstrike printing as indicated in the flow chart of FIG. 4. If the overstrike flag 80 is not "set" or in the "clear" state then the NO path from Box 102 is taken to the operational Box 104. In Box 104, stored character code data of the previously printed character at the cursor register 88 is recalled and typewriter 10 is operated in correction mode to erase the printed character. Upon erasure of the recalled character, the selected character for replacement is processed to print in the just erased carrier position to complete the replacement portion of the present invention.

According to the present invention, the electronics of circuit 44 is controlled to correct a previously printed character and to print a replacement character in response to one-touch actuation of the desired replacement character key. To accomplish this, the operator aligns carrier 18 opposite the unwanted character and actuates the key of the desired replacement character. The selected character signal is issued from keyboard 12 to control circuit 44 for electronic handling according to the flow chart of FIG. 4. Correction Buffer 84 is addressed at Box 96 to determine (in box 98) the register status of the cursor position 88 in memory register stack 86. This cursor position 88 has the character code of the unwanted character and the code is recalled for correction purposes. In Master Microprocessor 68, overstrike flag 80 in RAM 78 is interrogated and found to be presently in a "CLEAR" state. The recalled character signal of the unwanted character is communicated to Slave Microprocessor 90 to control appropriate Drivers 1–4 for operating typewriter 10 in correction mode to erase the previously printed unwanted character. Subsequently, the character code of the new selected replacement character is processed for printing in the just erased position. In this manner, any previously printed character may be automatically erased and a replacement character may be printed in response to one-touch actuation of the replacement character key provided the carrier 18 is aligned opposite the previously printed unwanted character.

According to the present invention, provision is made for permitting an overstrike operation using typewriter 10. For example, if the typist wishes to underline a previously printed character, the carrier 18 is aligned opposite the character, code key 42 is actuated and then an underscore character key 34 is depressed. The overstrike flag 80 is "SET" in response to actuation of the code key 42 and the decision made of Box 102 of the flow chart of FIG. 4 results in the Yes path being taken to Box 100 wherein the selected overstrike character key 34 (underscore) is processed to print normally. Exiting the overstrike mode or clearing flag 80 may be accomplished in a variety of ways including a second actuation of the code key 42, or a release of the code key 42 which is held down during overstrike operation, or automatically in response to printing of the overstrike character.

While a specific embodiment of the invention has been disclosed, those skilled in the art shall readily envision further modification and improvement based on the description. Accordingly, the invention is not to be limited to the description but is to be defined solely by the claims in any improvements and modifications falling within the scope of the claims as intended to be included within the invention.

What is claimed is:

1. A character correction and replacement system for use in an electronic correcting typewriter having a keyboard including a plurality of character and function keys selectable for issuing unique signals, a platen, a carrier, a printing mechanism supported on the carrier for printing characters at selected print positions on a recording medium supported on the platen, a correction mechanism for erasing previously printed characters from the recording medium, bi-directional feeding means for horizontally moving the carrier relative to the platen, electronic processor means for receiving the unique signals from selected keyboard keys and for controlling functional operation of typewriter mechanisms in accordance to the signals received, a correction buffer connected to the processor means, the correction buffer including a plurality of memory registers capable of storing therein character codes representative of the last plurality of printed characters and cursor means operative in the correction buffer for pointing to a selected one of the plurality of memory registers and the memory register pointed to by the cursor means relating to the current print position of the carrier, the character correction and replacement system comprising:

actuation means selective for generating a discrete signal representative of a replacement character and said discrete signal being communicated to the correction buffer for addressing the memory register pointed to by the cursor means and relating to the current print line position of the carrier; and control means responsive to said discrete signal addressing the memory register for generating a character correction and replacement command signal dependent upon the addressed memory register containing a stored character code of a previously printed character and said command signal utilized in the processor means to recall said character code for operating the correction mechanism to erase said previously printed character at the current print line position of the carrier and hence for operating the printing mechanism to print said replacement character selected by said actuation means.

2. The character correction and replacement system of claim 1 wherein said actuation means comprises the plurality of character keys.

3. The character correction and replacement system of claim 1 further comprising overstrike means for character printing in a print position occupied by a previously printed character which character has its code stored in the memory register pointed to by the cursor means.

4. The character correction and replacement system of claim 3 wherein said overstrike means includes a settable electronic flag for controlling overstrike functioning.

5. A method of operating a character correction and replacement system in an electronic correcting typewriter having a keyboard including a plurality of character keys for issuing unique signals representative of actuated keys, a platen, a carrier, a printing mechanism supported on the carrier for printing characters at selected print positions on a recording medium supported on the platen, a correction mechanism for erasing previously printed characters from the recording medium, bi-directional feeding means for horizontally moving the carrier relative to the platen, electronic processor means for receiving the unique signals from selected keyboard keys and for controlling functional operation of typewriter mechanisms in accordance to the signals received, a correction buffer connected to the processor means, the correction buffer including a plurality of memory registers capable of storing therein character codes representative of the last plurality of printed characters and cursor means operative in the correction buffer for pointing to a selected one of the plurality of memory registers, operation of the character correction and replacement system comprising the steps of:

(a) manually locating the carrier at a print line position for correcting a previously printed character;

(b) positioning the cursor means in the correction buffer to point to said selected one of said memory registers pointed to by relating to the current print line position of the carrier and said selected one of said memory registers containing a character code corresponding to said previously printed character;

(c) actuating a selected one of the plurality of character keys relating to a replacement character;

(d) generating a discrete replacement character signal responsive to step (c);

(e) communicating said discrete replacement character signal to the correction buffer for addressing said selected one of said memory registers pointed to by the cursor means;

(f) recalling the character code of said previously printed character from said selected one of said memory registers to the processor means;

(g) operating the correction mechanism under control of the recalled character code to erase said previously printed character; and then (h) operating the printing mechanism under control of said discrete replacement character signal to print the replacment character.

6. The method of operating the character correction and replacement system of claim 5 further comprising:

providing a character overstrike control means operative for selectively printing one character at a print line position occupied by a previously printed character.

* * * * *